US011391276B2

(12) United States Patent
Tanaka

(10) Patent No.: US 11,391,276 B2
(45) Date of Patent: Jul. 19, 2022

(54) FLUID CONTROL DEVICE

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/069,967

(22) Filed: Oct. 14, 2020

(65) Prior Publication Data

US 2021/0025379 A1 Jan. 28, 2021

Related U.S. Application Data

(63) Continuation of application No. PCT/JP2019/015015, filed on Apr. 4, 2019.

(30) Foreign Application Priority Data

May 29, 2018 (JP) ..... JP2018-102092

(51) Int. Cl.
*F04B 45/047* (2006.01)
*F04D 33/00* (2006.01)
*F04B 45/04* (2006.01)

(52) U.S. Cl.
CPC ..... *F04B 45/047* (2013.01); *F04B 45/043* (2013.01); *F04D 33/00* (2013.01)

(58) Field of Classification Search
CPC .... F04B 45/043; F04B 45/047; F04B 43/046; F04D 33/00
See application file for complete search history.

(56) References Cited

U.S. PATENT DOCUMENTS

2013/0071269 A1 3/2013 Fujisaki et al.
2016/0348666 A1* 12/2016 Tanaka ..... F04D 33/00
2017/0209655 A1 7/2017 Morrison
2018/0187672 A1 7/2018 Tanaka et al.
2020/0340469 A1* 10/2020 Tanaka ..... F04B 45/047
(Continued)

FOREIGN PATENT DOCUMENTS

CN 102459899 A 5/2012
JP 2009-250132 A 10/2009
(Continued)

OTHER PUBLICATIONS

International Search Report for PCT/JP2019/015015 dated Jul. 2, 2019.
Written Opinion for PCT/JP2019/015015 dated Jul. 2, 2019.

*Primary Examiner* — Charles G Freay
(74) *Attorney, Agent, or Firm* — Pearne & Gordon LLP

(57) ABSTRACT

A fluid control device includes: a case 200 that includes a case top plate having a first vent hole, a case side plate, and a case bottom plate having a second vent hole; a pump body; and a holding member that holds the pump body relative to the case. The pump body includes a first main plate, a second main plate that faces one main surface of the first main plate, a side plate, and a driving member that is arranged on the first main plate. The first main plate includes a plurality of first openings arranged in a ring shape. The second main plate is arranged at a side of the first main plate nearer the case top plate and has a second opening at a position that overlaps the first vent hole in a plan view.

18 Claims, 12 Drawing Sheets

(56) References Cited

U.S. PATENT DOCUMENTS

| | | | | |
|---|---|---|---|---|
| 2020/0370544 | A1* | 11/2020 | Tanaka | A61H 9/005 |
| 2021/0025379 | A1 | 1/2021 | Tanaka | |
| 2021/0143084 | A1* | 5/2021 | Ganti | H01L 41/0973 |

FOREIGN PATENT DOCUMENTS

| | | | |
|---|---|---|---|
| JP | 2017-521181 | A | 8/2017 |
| WO | 2010/139918 | A1 | 12/2010 |
| WO | 2011/040320 | A1 | 4/2011 |
| WO | 2014/024608 | A1 | 2/2014 |
| WO | 2017/038565 | A1 | 3/2017 |
| WO | 2019/230189 | A1 | 12/2019 |

* cited by examiner

FLUID CONTROL DEVICE

CROSS REFERENCE TO RELATED APPLICATION

This is a continuation of International Application No. PCT/JP2019/015015 filed on Apr. 4, 2019 which claims priority from Japanese Patent Application No. 2018-102092 filed on May 29, 2018. The contents of these applications are incorporated herein by reference in their entireties.

BACKGROUND

Technical Field

The present disclosure relates to a fluid control device that conveys a fluid in one direction.

Heretofore, a variety of fluid control devices equipped with a driving element, such as a piezoelectric element have been implemented.

Patent Document 1 discloses a cooling device (fluid control device) that includes a pump chamber. A piezoelectric pump described in Patent Document 1 causes a gas to flow out of a nozzle by generating inertia in a gas that flows into the piezoelectric pump from the outside.

Patent Document 1: Japanese Unexamined Patent Application Publication No. 2009-250132

BRIEF SUMMARY

However, with the structure of the fluid control device disclosed in Patent Document 1, backflow may occur when the gas is sucked in and the desired flow rate may not be obtained.

The present disclosure provides a fluid control device in which a flow rate is efficiently obtained for a fluid.

A fluid control device according to the present disclosure includes: a case including a case top plate having a first vent hole substantially at a center (the "substantially at the center" can deviate from the center less than 1% in length of the total length from one end to the other end of a main surface of the case top plate) thereof, a case side plate that is connected to the case top plate, and a case bottom plate that is connected to the case side plate and has a second vent hole substantially at a center (the "substantially at the center" can deviate from the center less than 1% in length of the total length from one end to the other end of a main surface of the case bottom plate) thereof; a pump body that is arranged inside a space enclosed by the case top plate, the case side plate, and the case bottom plate of the case; and a holding member that holds the pump body relative to the case. The pump body includes a first main plate, a second main plate having one main surface that faces one main surface of the first main plate, a side plate that connects the first main plate and the second main plate to each other, and a driving member that is arranged on the first main plate. The holding member connects the side plate and the case side plate to each other. The first main plate includes a plurality of first openings arranged in a ring shape. The second main plate is arranged at a side of the first main plate nearer the case top plate and has a second opening at a position that overlaps the first vent hole in a plan view.

With this configuration, a fluid can be made to flow into the pump body from the first openings, and therefore the amount of fluid flowing out from the second opening is increased and the flow rate of the fluid control device is increased.

The second main plate or the holding member of the fluid control device of the present disclosure may have a third opening that allows the first vent hole and the second vent hole to communicate with each other.

With this configuration, when the fluid is being discharged from the fluid control device, the fluid flowing in through the third opening is drawn in. This increases the flow rate of the fluid control device.

In the fluid control device of the present disclosure, the case top plate may include a third vent hole at a position that is separated from a center of the case top plate in a plan view of the case top plate (viewed in a direction perpendicular to a main surface of the case top plate), and the second main plate may have fourth openings that overlap the third vent hole in a plan view (viewed in a direction perpendicular to a main surface of the second main plate).

With this configuration, the fluid can be discharged through the third vent hole while the fluid is not being discharged from the first vent hole and the flow rate of the fluid control device is increased.

The second main plate of the fluid control device of the present disclosure may include a plurality of fifth openings that do not overlap the first vent hole and the third vent hole.

With this configuration, the flow rate of the fluid discharged from the second main plate of the pump body is increased and therefore the flow rate of the fluid is increased.

The fifth openings of the fluid control device of the present disclosure may be located between the second opening and the fourth openings in a plan view of the second main plate.

With this configuration, the flow rate of the fluid discharged from the second main plate of the pump body is increased and therefore the flow rate of the fluid is increased.

The fourth openings of the fluid control device of the present disclosure may be formed in a ring shape so as to overlap an antinode of vibration of the first main plate in accordance with a vibration order of the driving member.

With this configuration, the flow velocity of the discharge flow from the fourth openings is high, and therefore the surrounding fluid can be strongly drawn in, further increasing the flow of the fluid control device and further improving the pressure.

The fifth openings of the fluid control device of the present disclosure may be formed in a ring shape so as to overlap a node of vibration of the first main plate in accordance with a vibration order of the driving member.

With this configuration, backflow from the fifth openings can be suppressed and therefore the flow rate of the fluid control device is further increased and the pressure is further increased.

The first openings of the fluid control device of the present disclosure may be formed outside the driving member in a plan view of the first main plate.

With this configuration, the first main plate more easily vibrates due to the increased flexibility near the positions where the first openings are formed. In other words, it is easier for the fluid to flow into the device.

According to the present disclosure, a fluid control device can be provided in which the flow rate of a fluid is efficiently obtained.

DETAILED DESCRIPTION

First Embodiment

Figure 1A:
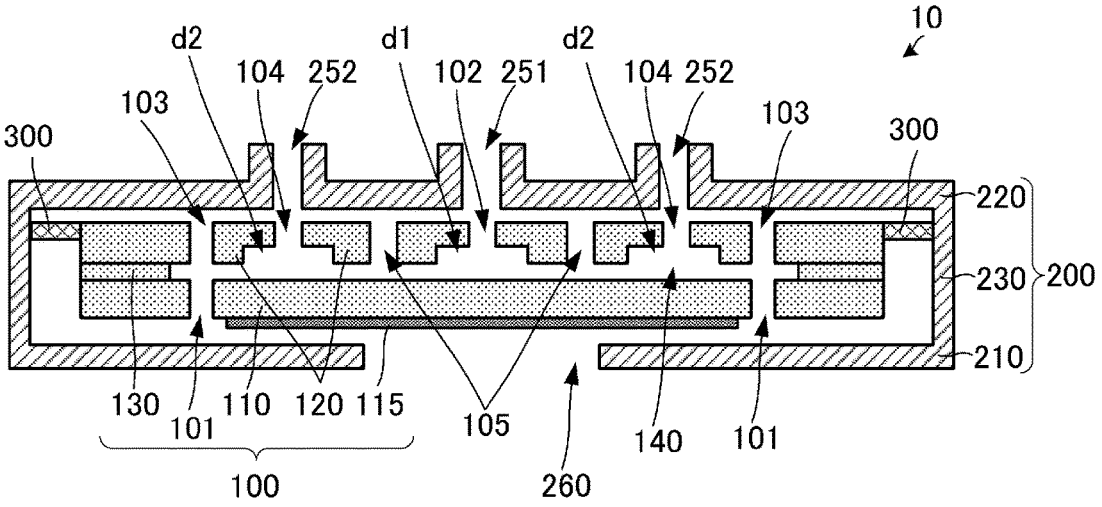
FIG. 1A is a lateral sectional view of a fluid control device 10 according to a first embodiment of the present disclosure and FIG. 1B is a diagram schematically illustrating an example of a vibration state of a first main plate 110.
Figure 1B:
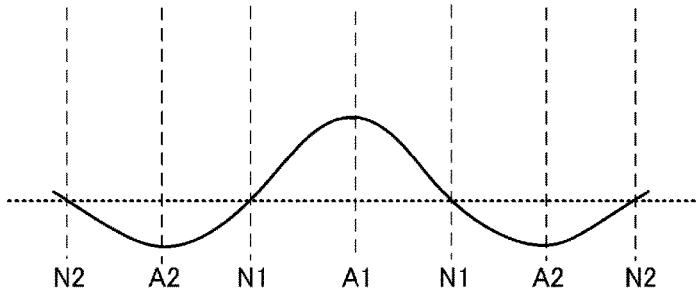
Figure 2B:
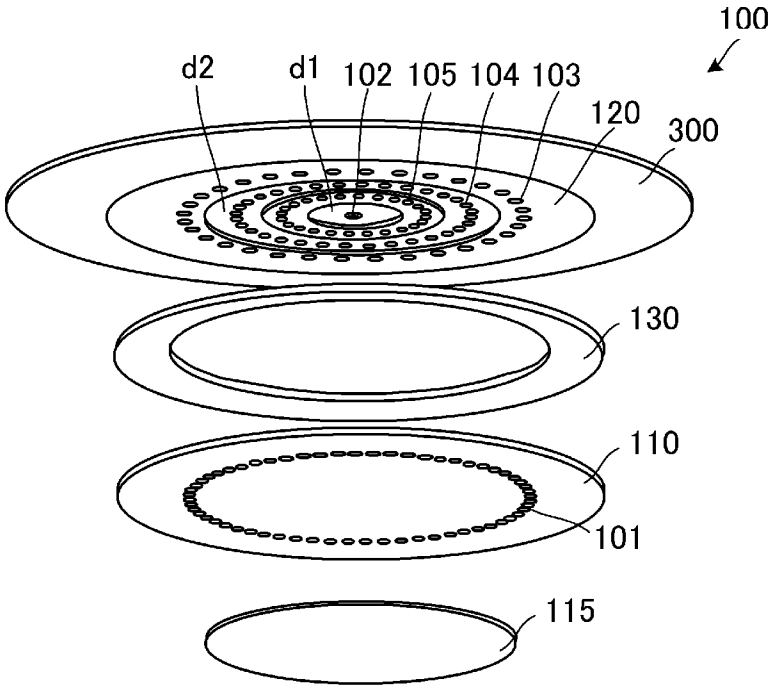
FIG. 2B is an exploded perspective view in which the pump body 100 according to the first embodiment of the present disclosure is viewed from the first main plate 110 side.
Figure 2A:
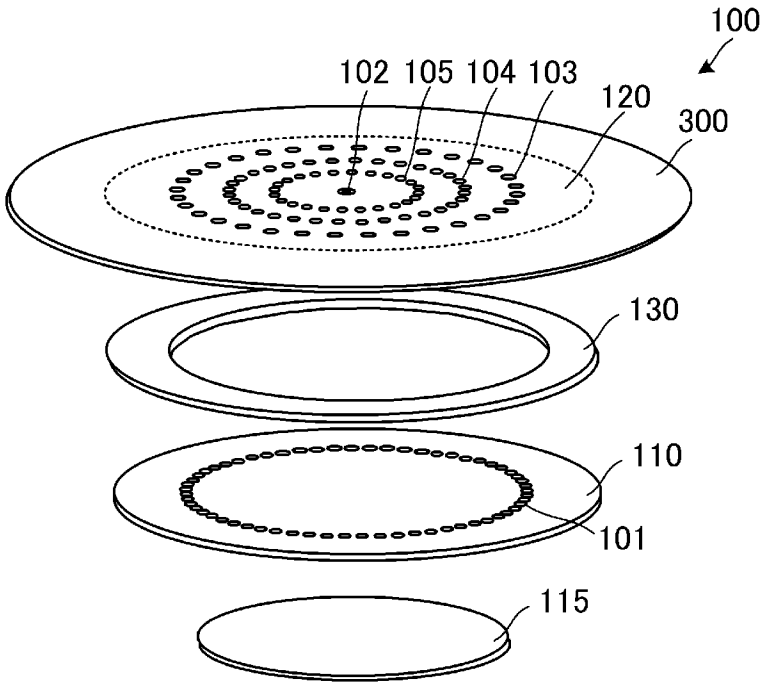
FIG. 2A is an exploded perspective view in which a pump body 100 according to the first embodiment of the present disclosure is viewed from a second main plate 120 side.
Figure 3A:
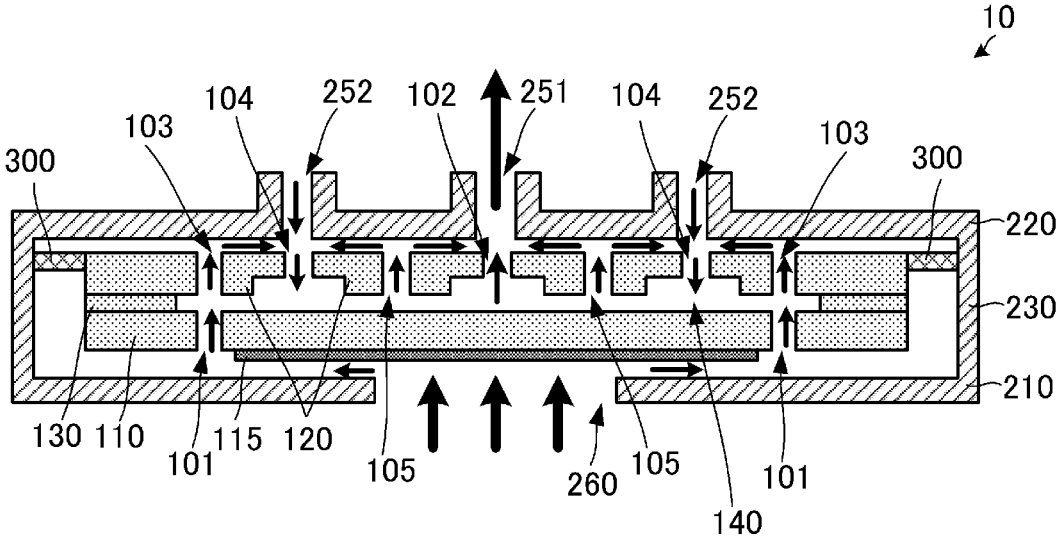
FIG. 3A is a lateral sectional view of the fluid control device 10 according to the first embodiment of the present disclosure illustrating fluid flow when a fluid is discharged from a first nozzle 251.
Figure 3B:
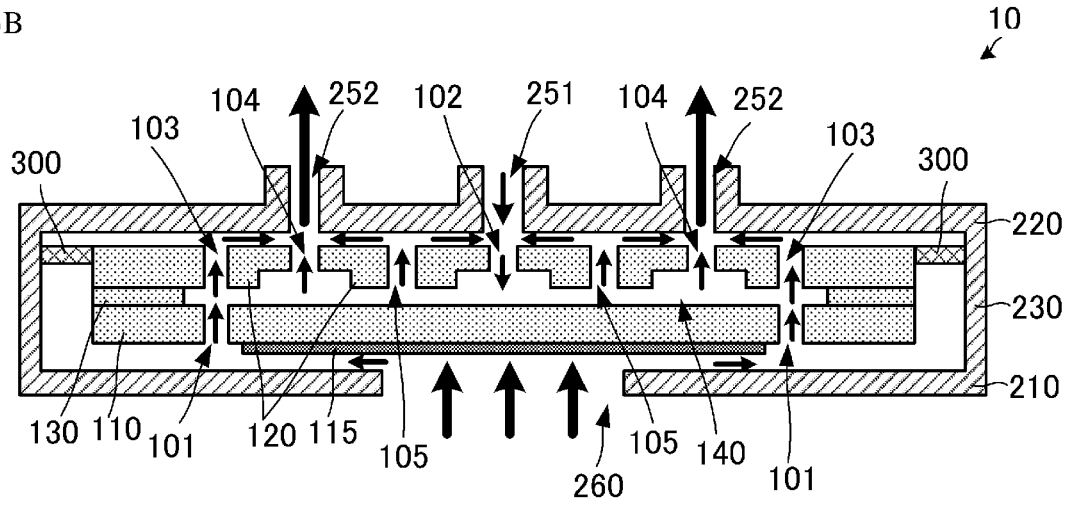
FIG. 3B is a lateral sectional view of the fluid control device 10 according to the first embodiment of the present disclosure illustrating fluid flow when a fluid is discharged from second nozzles 252.

A fluid control device according to a first embodiment of the present disclosure will be described while referring to the drawings. FIG. 1A is a lateral sectional view of a fluid control device 10 according to a first embodiment of the present disclosure and FIG. 1B is a diagram schematically illustrating an example of a vibration state of a first main plate 110. FIG. 2A is an exploded perspective view in which a pump body 100 according to the first embodiment of the present disclosure is viewed from a second main plate 120 side. FIG. 2B is an exploded perspective view in which the pump body 100 according to the first embodiment of the present disclosure is viewed from the first main plate 110 side. FIG. 3A is a lateral sectional view of the fluid control device 10 according to the first embodiment of the present disclosure illustrating fluid flow when a fluid is discharged from a first nozzle 251. FIG. 3B is a lateral sectional view of the fluid control device 10 according to the first embodiment of the present disclosure illustrating fluid flow when a fluid is discharged from second nozzles 252. To make the figures easier to understand, some reference symbols are omitted and some structures are illustrated in an exaggerated manner.

As illustrated in FIGS. 1A and 1B, the fluid control device 10 includes a pump body 100, a case 200, and a holding member 300.

The pump body 100 is connected to the inside of the case 200 by the holding member 300. A case top plate 220 includes a first nozzle 251 and second nozzles 252. More specific structures and connection methods will be described later. The first nozzle 251 corresponds to a first vent hole of the present disclosure and the second nozzles 252 correspond to a third vent hole of the present disclosure.

First, the structure of the pump body 100 will be described. The pump body 100 includes the first main plate 110, the second main plate 120, and a side plate 130. A driving member 115 is arranged on the first main plate 110.

As illustrated in FIGS. 1A, 1B, 2A, and 2B, the first main plate 110 and the second main plate 120 are circular plates. In addition, the side plate 130 is a cylinder.

The side plate 130 is arranged between the first main plate 110 and the second main plate 120 and the side plate 130 connects the first main plate 110 and the second main plate 120 to each other so that the first main plate 110 and the second main plate 120 face each other. More specifically, in a plan view, the centers of the first main plate 110 and the second main plate 120 are aligned with each other. The side plate 130 connects the thus-arranged first main plate 110 and second main plate 120 to each other along the entire peripheries thereof.

As a result of having this configuration, the pump body 100 has a pump chamber 140 that is a cylindrical space enclosed by the first main plate 110, the second main plate 120, and the side plate 130.

The first main plate 110 includes a plurality of first openings 101. The first openings 101 penetrate through the first main plate 110. The first openings 101 are formed in a ring shape in a plan view of the first main plate 110. More specifically, the first openings 101 are formed outside the driving member 115 in a plan view of the first main plate 110 (viewed in a direction perpendicular to a main surface of the first main plate 110). This enables the flow channel resistance of the first openings 101 to be reduced. In addition, the occurrence of cracking of the driving member 115 is suppressed. The first main plate 110 vibrates more easily due to the increased flexibility in the vicinity of the positions where the first openings 101 are formed. In other words, an effect is exhibited that it is easier for a fluid to flow into the device.

The second main plate 120 includes a second opening 102. The second opening 102 penetrate through the second main plate 120. The second opening 102 is formed at a position at the center of the second main plate 120 in a plan view of the second main plate 120.

In addition, the second main plate 120 has a plurality of third openings 103, a plurality of fourth openings 104, and a plurality of fifth openings 105. The third openings 103 are formed in a ring shape in a plan view of the first main plate 110. The fourth openings 104 are formed in a ring shape in a plan view of the first main plate 110. The fifth openings 105 are formed in a ring shape in a plan view of the first main plate 110. The specific formation positions will be described later.

As illustrated in FIGS. 1A and 2B, a recess d1 is provided in a ring shape in an area where the second opening 102 is formed opposite the first nozzle 251. In addition, a recess d2 is formed in a ring shape in an area where the fourth openings 104 are formed opposite the second nozzles 252. This enables the flow channel resistance in the second opening 102 and the fourth openings 104 to be reduced. In addition, the vibration efficiency of an antinode, which is described later, is improved. In other words, a greater flow rate can be obtained from the first nozzle 251 and the second nozzles 252.

The driving member 115 is arranged on a surface of the first main plate 110 that is on the opposite side from the second main plate 120. The driving member 115 has a piezoelectric element and is connected to a control unit, which is not illustrated. The control unit generates a driving signal for the piezoelectric element and applies the driving signal to the piezoelectric element. The piezoelectric element is displaced due to the driving signal and stress caused by this displacement acts on the first main plate 110. As a result, the first main plate 110 undergoes bending vibration. For example, the vibration of the first main plate 110 produces the shape of a Bessel function of the first kind.

The volume and pressure of the pump chamber 140 change as a result of the first main plate 110 undergoing bending vibration in this way.

Next, the structure of the case 200 will be described. The case 200 includes a case bottom plate 210, the case top plate 220, and a case side plate 230. The case bottom plate 210 has an inflow opening 260 at the center thereof. The inflow opening 260 corresponds to a second vent hole of the present disclosure.

The case side plate 230 is arranged between the case bottom plate 210 and the case top plate 220 and connects the case bottom plate 210 and the case top plate 220 to each other so that the case bottom plate 210 and the case top plate 220 face each other. More specifically, the centers of the case bottom plate 210 and the case top plate 220 are aligned in a plan view. The case side plate 230 connects the thus-arranged case bottom plate 210 and case top plate 220 to each other along the entire peripheries thereof. Note that although it is sufficient that the case 200 be of such a size that the pump body 100 can be formed thereinside, the case 200 can have a similar shape to the pump body 100. For example, in one embodiment, each of the case top plate 220 and the case bottom plate 210 has a similar shape to the pump body 100 when viewed in a direction perpendicular to the second mail plate 120. When each of the case top plate 220 and the case bottom plate 210 has a circular shape similar to the circular shape of the second main plate 120, the case side plate 230 connecting the entire ends of the case top late 220 and the case bottom plate 210 has a circular shape when viewed in a direction perpendicular to the second mail plate 120. A diameter of each of the case top plate 220 and the case bottom plate 210 is wider than a diameter of an outer end of the holding member 300 when viewed in a direction perpendicular to the second mail plate 120. This improves the performance of the fluid control device 10.

The case top plate 220 includes the first nozzle 251. The first nozzle 251 is formed at a position at the center of the case top plate 220. The region of the case top plate 220 where first nozzle 251 is formed is thicker than the regions of the case top plate 220 where the first nozzle 251 is not formed. The first nozzle 251 is formed by forming a through hole in the center of this region where the first nozzle 251 is to be formed. The inside and the outside of the case 200 are connected by the first nozzle 251.

In addition, the case top plate 220 includes a plurality of second nozzles 252. The second nozzles 252 are formed between the first nozzle 251 and the case side plate 230 in a plan view of the case top plate 220. The specific formation positions will be described later. The regions of the case top plate 220 where the second nozzles 252 are formed are thicker than the regions of the case top plate 220 where the second nozzles 252 are not formed. The second nozzles 252 are formed by forming through holes in the centers of these regions where the second nozzles 252 are to be formed. The inside and the outside of the case 200 are connected by the second nozzles 252.

As described above, the pump body 100 and the case 200 are connected to each other by the holding member 300. More specifically, the holding member 300 connects the side plate 130 of the pump body 100 and the case side plate 230 of the case 200 to each other through the second main plate 120 and the second main plate 120 and the case top plate 220 are formed so as to be parallel to each other. In addition, the pump body 100 and the case 200 are formed so that the centers thereof overlap in a plan view. The holding member 300 may be formed so as to be integrated with the second main plate 120.

As described above, as a result of the pump body 100 and the case 200 having similar shapes to each other, a flow channel is formed between the case 200 and the pump body 100.

Next, a more specific positional relationship between the first openings 101, the second opening 102, the third openings 103, the fourth openings 104 and the fifth openings 105 and the first nozzle 251 and the second nozzles 252 will be described.

As illustrated in FIG. 1B, the vibration of the first main plate 110 forms the waveform of a Bessel function of the first kind. The vibration of the first main plate 110 generates an antinode A1, a node N1, an antinode A2, and a node N2 from the center of the first main plate 110 toward the outer edge of the first main plate 110 (side plate 130). The amplitude is greatest at the antinode A1, which is located at the center of the first main plate 110.

First, the positions at which the first openings 101, the second opening 102, the third openings 103, the fourth openings 104, and the fifth openings 105 are formed in the pump body 100 will be described.

As described above, the first openings 101 are formed at positions that do not overlap the driving member 115, i.e., are formed at positions closest to the side plate 130 in a plan view of the first main plate 110. More specifically, the first openings 101 are formed at positions near the node N2, i.e., are formed at positions where displacement of the first main plate 110 is small.

The second opening 102 is formed at a position at the center of the second main plate 120 of the pump body 100. More specifically, the second opening 102 is formed at a position that overlaps the antinode A1.

The third openings 103 are formed at positions that overlap the node N2 in a plan view of the second main plate 120. In addition, the third openings 103 may be formed at positions that overlap the first openings 101 in a plan view. The first nozzle 251 and the inflow opening 260 are able to communicate with each other as a result of the third openings 103 being formed.

The fourth openings 104 are formed at positions that overlap the antinode A2 in a plan view of the second main plate 120.

The fifth openings 105 are formed at positions that overlap the node N1 in a plan view of the second main plate 120. More specifically, the fifth openings 105 are formed at positions interposed between the second opening 102 and the fourth openings 104 in a plan view of the second main plate 120 (viewed in a direction perpendicular to a main surface of the second main plate 120).

Therefore, the second opening 102, the fifth openings 105, the fourth openings 104, and the third openings 103 are formed in this order in a direction from a position at the center of the second main plate 120 toward the outer edge of the second main plate 120 (side plate 130).

Next, the specific positions at which the first nozzle 251 and the second nozzles 252 are formed in the case 200 will be described.

The first nozzle 251 is formed at a position at the center of the case 200. As described above, the center of the pump body 100 and the center of the case 200 overlap. In other words, the first nozzle 251 is formed at a position (antinode A1) that overlaps the second opening 102 in a plan view.

The second nozzles 252 are formed at positions that overlap the fourth openings 104 in a plan view. In other words, the second nozzles 252 are formed at positions that overlap the antinode A2.

Therefore, a fluid is discharged from both the first nozzle 251 and the second nozzles 252 and the flow rate is increased.

Next, the fluid flow in the fluid control device 10 will be described using FIGS. 1A, 1B, 3A, and 3B. The fluid flow is represented using arrows.

As illustrated in FIG. 3A, when the first main plate 110 and the second main plate 120 are close each other at the antinode A1, that is, when the pump chamber 140 is contracted at the antinode A1, the region of the second opening 102 is locally under a positive pressure. Therefore, the second opening 102 discharges the fluid from the pump chamber 140 toward the case top plate 220 of the pump body 100. This fluid draws the fluid from the fifth openings 105 thereinto via the Venturi effect and is then discharged to the outside from the first nozzle 251. The discharge flow rate of the first nozzle 251 at this time is DA1.

On the other hand, as illustrated in FIG. 3B, when the first main plate 110 and the second main plate 120 are separated from each other at the antinode A1, i.e., when the pump chamber 140 is expanded at the antinode A1, the first main plate 110 and the second main plate 120 are close to each other at the antinode A2 and the pump chamber 140 is contracted at the antinode A2. Therefore, the regions of the fourth openings 104 are locally under a positive pressure. Therefore, the fourth openings 104 discharge the fluid from the pump chamber 140 toward the case top plate 220 of the pump body 100. This fluid draws the fluid from the third openings 103 and the fifth openings 105 thereinto via the Venturi effect and is then discharged to the outside from the second nozzles 252. The discharge flow rate of the second nozzles 252 at this time is DA2.

As described above, when the first main plate 110 and the second main plate 120 are close to each other at the antinode A1 (FIG. 3A), the first main plate 110 and the second main plate 120 are separated from each other at the antinode A2 and the pump chamber 140 is expanded at the antinode A2, and therefore the regions of the fourth openings 104 are locally under a negative pressure. Therefore, the fluid flows into the pump chamber 140 from the fourth openings 104. However, much of the inflowing fluid flows out through the third openings 103 and the fifth openings 105, flows through the space between the second main plate 120 and the case top plate 220, and then flows in through the fourth openings 104. Consequently, the backflow from the second nozzles 252 is smaller than the discharge flow rate DA2 from the second nozzles 252. Therefore, a discharge flow rate can be obtained from the second nozzles 252 for the entire vibration period of the first main plate 110.

Similarly, as described above, when the first main plate 110 and the second main plate 120 are separated from each other at the antinode A1 and the pump chamber 140 is expanded at antinode A1 (FIG. 3B), the region of the second opening 102 is locally under a negative pressure. Therefore, the fluid flows into the pump chamber 140 from the second opening 102. However, much of the inflowing fluid flows out through the fifth openings 105, flows through the space between the second main plate 120 and the case top plate 220, and then flows in through the second opening 102, and therefore the backflow from the first nozzle 251 is smaller than the discharge flow rate DA1 from the first nozzle 251. Therefore, a discharge flow rate can be obtained from the first nozzle 251 for the entire vibration period of the first main plate 110.

The fluid steadily flows into the pump chamber 140 through the first openings 101 for the following reason. A steady high-velocity drawn-in flow is generated between the second main plate 120 and the case top plate 220. However, a drawn-in flow is not generated outside the first openings 101. Therefore, as expressed by Bernoulli's theorem, inflow of the fluid from the first openings 101 into the pump chamber 140 occurs because the pressure outside the first openings 101, which have a lower flow velocity, is higher than the pressure in the space between the second main plate 120 and the case top plate 220, which has a higher flow velocity.

In the fluid control device 10 according to the first embodiment as described above, a flow from the inflow opening 260 to the first nozzle 251 can be generated.

Furthermore, since the discharge timing alternates between the first nozzle 251 and the second nozzles 252, constant discharge is possible. In other words, the flow rate is increased in the fluid control device 10. For example, the pressure that can be generated in the fluid control device 10 is 8 kPa and the flow rate is 6 L/min.

Second Embodiment

Figure 4A:
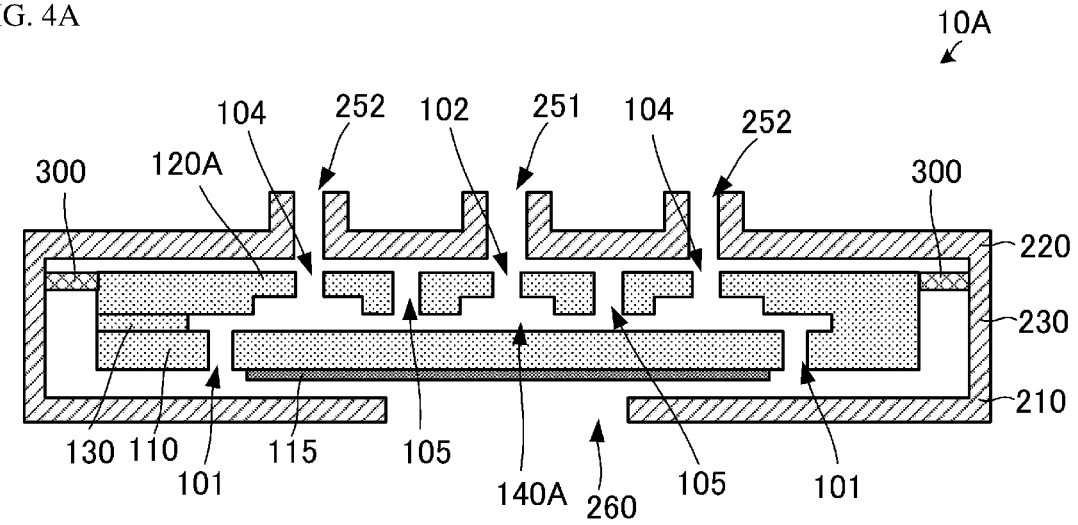
FIG. 4A is a lateral sectional view of a fluid control device 10A according to a second embodiment of the present disclosure and FIG. 4B is a diagram schematically illustrating an example of a vibration state of the first main plate 110.
Figure 4B:
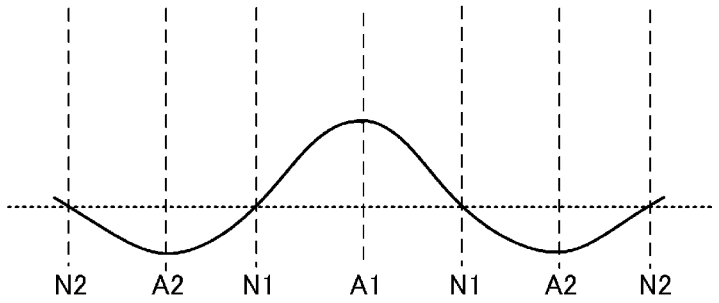
Figure 5B:
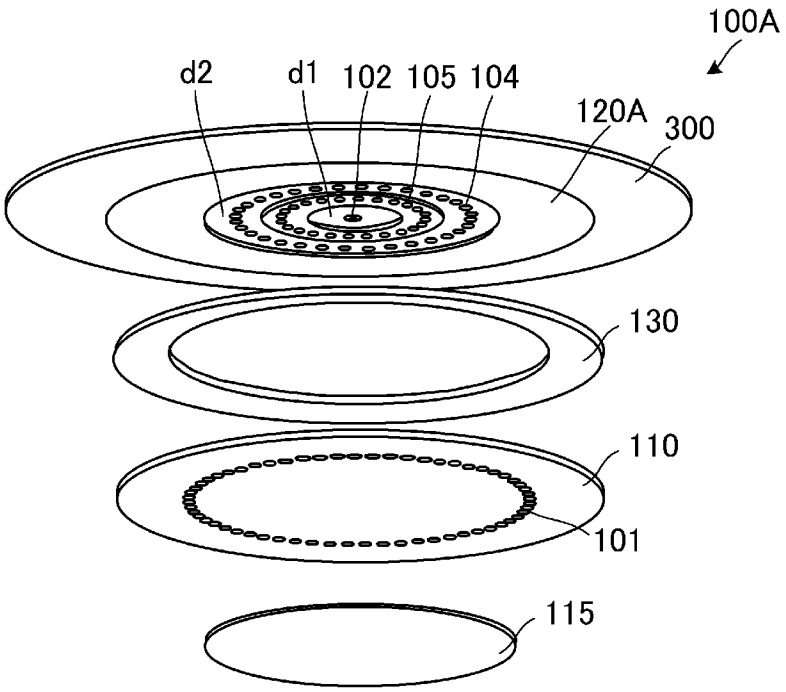
FIG. 5B is an exploded perspective view in which the pump body 100A according to the second embodiment of the present disclosure is viewed from the first main plate 110 side.
Figure 5A:
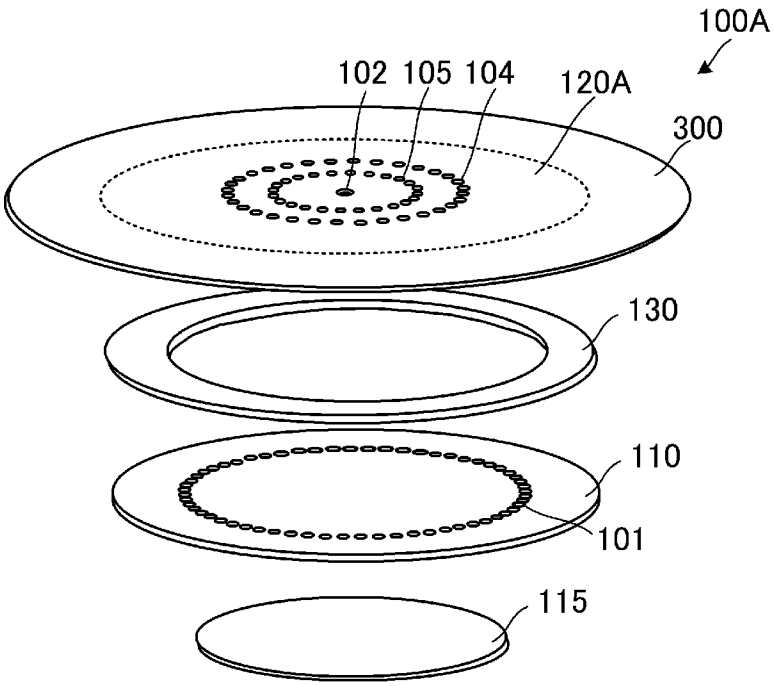
FIG. 5A is an exploded perspective view in which a pump body 100A according to the second embodiment of the present disclosure is viewed from a second main plate 120A side.
Figure 6A:
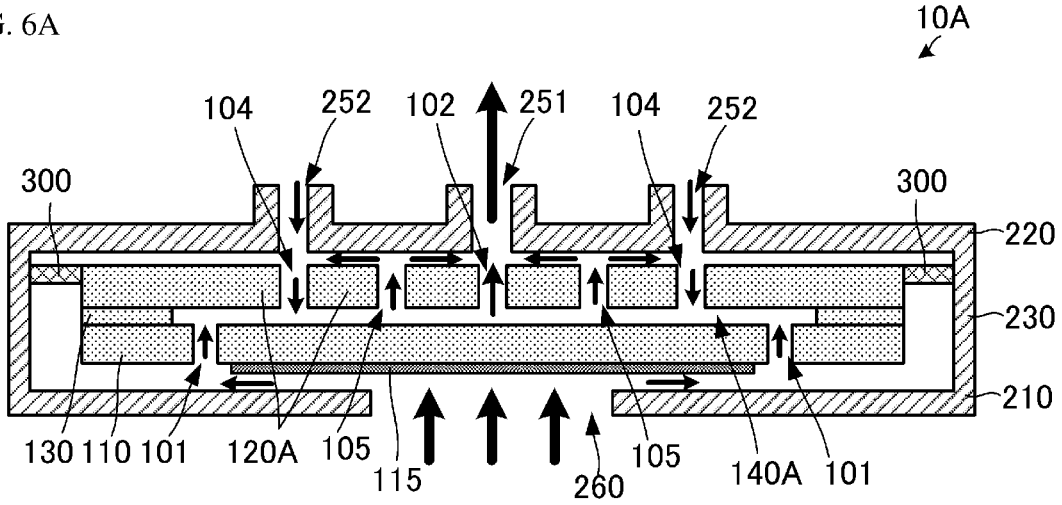
FIG. 6A is a lateral sectional view of the fluid control device 10A according to the second embodiment of the present disclosure illustrating fluid flow when a fluid is discharged from the first nozzle 251.
Figure 6B:
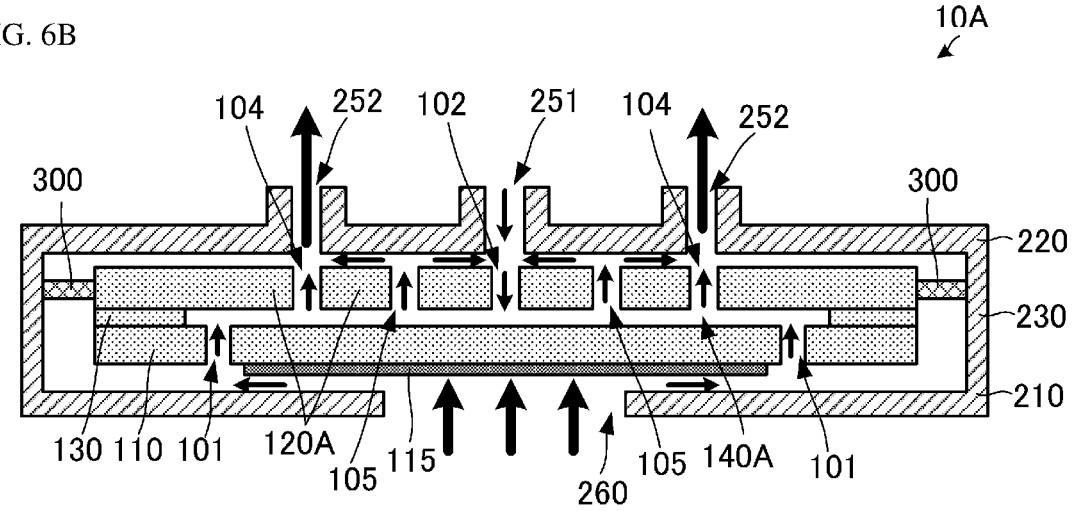
FIG. 6B is a lateral sectional view of the fluid control device 10A according to the second embodiment of the present disclosure illustrating fluid flow when a fluid is discharged from the second nozzles 252.

A fluid control device according to a second embodiment of the present disclosure will be described while referring to the drawings. FIG. 4A is a lateral sectional view of a fluid control device 10A according to the second embodiment of the present disclosure and FIG. 4B is a diagram schematically illustrating an example of a vibration state of the first main plate 110. FIG. 5A is an exploded perspective view in which a pump body 100A according to the second embodiment of the present disclosure is viewed from a second main plate 120A side. FIG. 5B is an exploded perspective view in which the pump body 100A according to the second embodiment of the present disclosure is viewed from the first main plate 110 side. FIG. 6A is a lateral sectional view of the fluid control device 10A according to the second embodiment of the present disclosure illustrating fluid flow when a fluid is discharged from the first nozzle 251. FIG. 6B is a lateral sectional view of the fluid control device 10A according to the second embodiment of the present disclosure illustrating fluid flow when a fluid is discharged from the second nozzles 252. To make the figures easier to understand, some reference symbols are omitted and some structures are illustrated in an exaggerated manner.

The fluid control device 10A of the second embodiment differs from the fluid control device 10 of the first embodiment in that the third openings 103 are not formed. The rest of the configuration of the fluid control device 10A is the same as that of the fluid control device 10 and description of these identical parts is omitted.

Drawn-in flows from the third openings 103 are not generated in this embodiment. However, there are drawn-in flows from the fifth openings 105 and therefore a similar effect to as in the first embodiment is obtained.

Third Embodiment

Figure 7A:
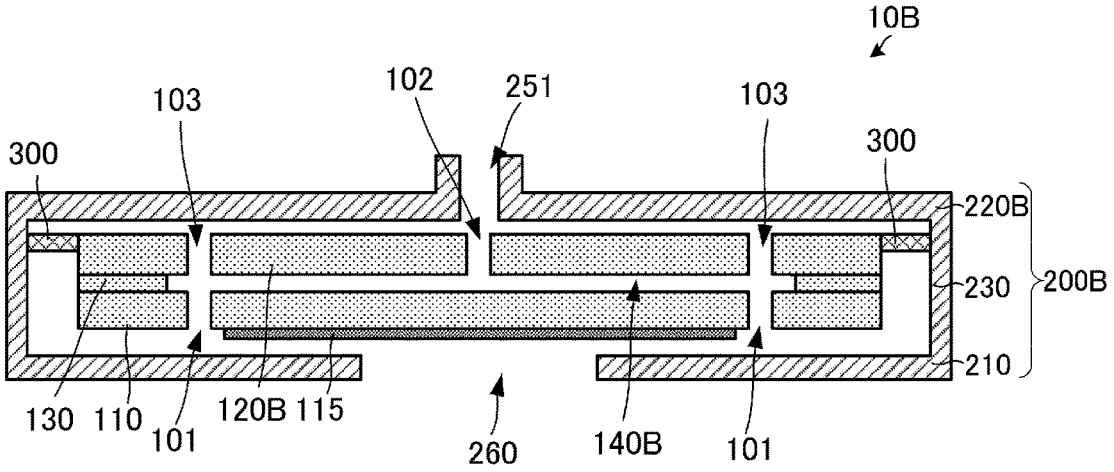
FIG. 7A is a lateral sectional view of a fluid control device 10B according to a third embodiment of the present disclosure and FIG. 7B is a diagram schematically illustrating an example of a vibration state of the first main plate 110.
Figure 7B:
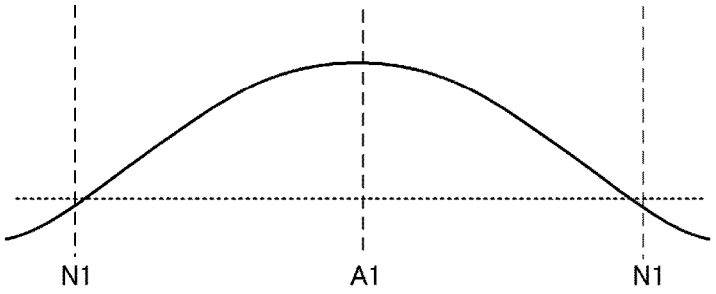
Figure 8:
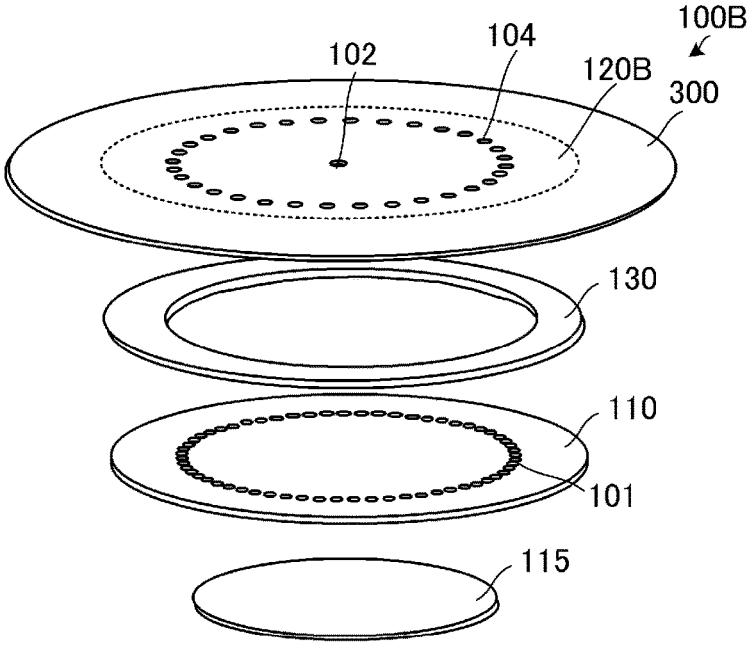
FIG. 8 is an exploded perspective view in which a pump body 100B according to the third embodiment of the present disclosure is viewed from a second main plate 120B side.
Figure 9A:
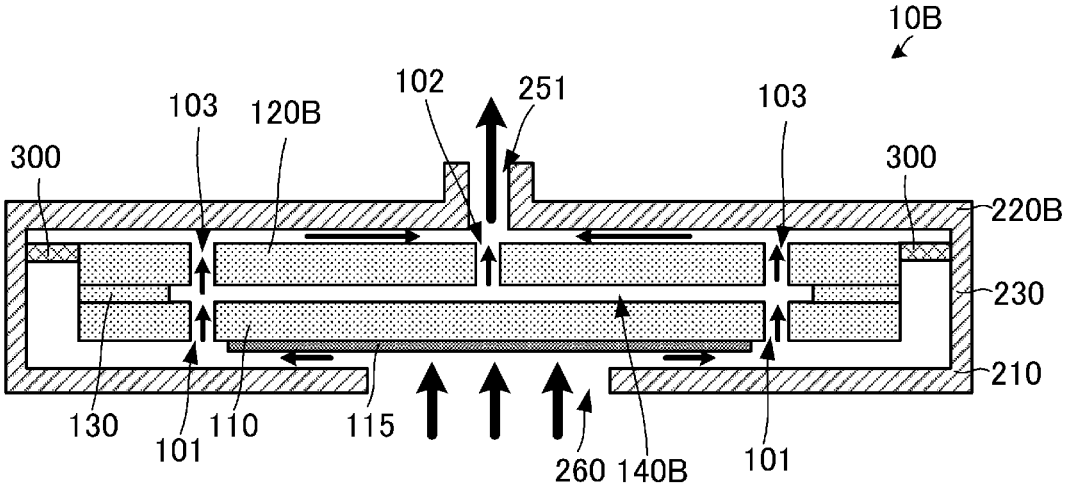
FIG. 9A is a lateral sectional view of the fluid control device 10B according to the third embodiment of the present disclosure illustrating fluid flow when a fluid is discharged from the first nozzle 251.
Figure 9B:
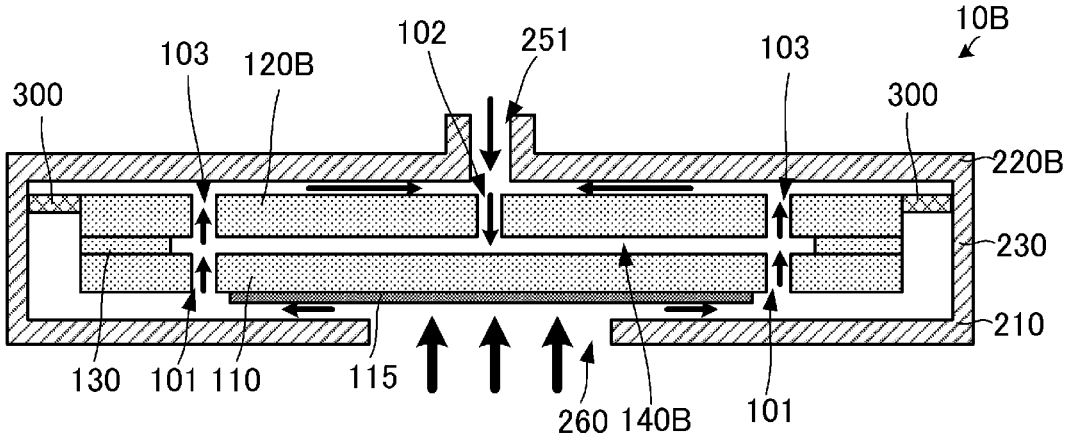
FIG. 9B is a lateral sectional view of the fluid control device 10B according to the third embodiment of the present disclosure illustrating fluid flow when a fluid is sucked in from the first nozzle 251.

A fluid control device according to a third embodiment of the present disclosure will be described while referring to the drawings. FIG. 7A is a lateral sectional view of a fluid control device 10B according to the third embodiment of the present disclosure and FIG. 7B is a diagram schematically illustrating an example of a vibration state of the first main plate 110. FIG. 8 is an exploded perspective view in which a pump body 100B according to the third embodiment of the present disclosure is viewed from a second main plate 120B side. FIG. 9A is a lateral sectional view of the fluid control device 10B according to the third embodiment of the present disclosure illustrating fluid flow when a fluid is discharged from the first nozzle 251. FIG. 9B is a lateral sectional view of the fluid control device 10B according to the third embodiment of the present disclosure illustrating fluid flow when a fluid is sucked in from the first nozzle 251. To make the figures easier to understand, some reference symbols are omitted and some structures are illustrated in an exaggerated manner.

As illustrated in FIGS. 7A, 7B, 8, 9A, and 9B, the fluid control device 10B according to the third embodiment differs from the fluid control device 10 according to first embodiment in that the fluid control device 10B according to the third embodiment does not include the fourth openings 104 and the fifth openings 105 and does not include the second nozzles 252, and in that the vibration order of the first main plate 110 is a first order vibration. The rest of the configuration of the fluid control device 10B is the same as that of the fluid control device 10 and description of these identical parts is omitted.

As illustrated in FIGS. 7A, 7B, and 8, the fluid control device 10B includes the pump body 100B, a case 200B, and the holding member 300.

As illustrated in FIG. 7B, the vibration of the first main plate 110 follows the waveform of a Bessel function of the first kind. The vibration of the first main plate 110 generates an antinode A1 and a node N1 from the center of the first main plate 110 toward the outer edge of the first main plate 110 (side plate 130). The amplitude is greatest at the antinode A1, which is located at the center of the driving member 115.

As illustrated in FIGS. 7A and 7B, the first openings 101 are formed at positions that do not overlap the driving member 115 in a plan view of the first main plate 110. More specifically, the first openings 101 are formed at positions near the node N1, i.e., are formed at positions where displacement of the first main plate 110 is small.

The second opening 102 is formed at a position in the center of the second main plate 120B of the pump body 100B. More specifically, the second opening 102 is formed at a position that overlaps the antinode A1.

The third openings 103 are formed at positions that overlap the first openings 101 in a plan view of the second main plate 120B. More specifically, the third openings 103 are formed at positions near the node N1.

Next, the fluid flow in the fluid control device 10B will be described using FIGS. 7A, 7B, 9A, and 9B. The fluid flow is represented using arrows.

As illustrated in FIG. 9A, when the first main plate 110 and the second main plate 120B are close each other at the antinode A1, that is, when a pump chamber 140B is contracted at the antinode A1, the region of the second opening 102 is locally under a positive pressure. Therefore, the second opening 102 discharges the fluid from the pump chamber 140B toward a case top plate 220B of the pump body 100B. This fluid draws the fluid from the third openings 103 thereinto via the Venturi effect and is then discharged to the outside from the first nozzle 251. The discharge flow rate of the first nozzle 251 at this time is DA3.

As illustrated in FIG. 9B, when the first main plate 110 and the second main plate 120B are separated from each other at the antinode A1, that is, when the pump chamber 140B is expanded at the antinode A1, the region of the second opening 102 is locally under a negative pressure. Therefore, the fluid flows into the pump chamber 140B from the second opening 102. However, much of the inflowing fluid flows out through the third openings 103, flows through the space between the second main plate 120B and the case top plate 220B, and then flows in through the second opening 102. Consequently, the backflow from the first nozzle 251 is smaller than the discharge flow rate DA3 from the first nozzle 251. Therefore, a discharge flow rate can be obtained from the first nozzle 251 for the entire vibration period of the first main plate 110.

The fluid steadily flows into the pump chamber 140B through the first openings 101 for the following reason. A steady high-velocity drawn-in flow is generated between the second main plate 120B and the case top plate 220B. However, a drawn-in flow is not generated outside the first openings 101. Therefore, as expressed by Bernoulli's theorem, the pressure outside the first openings 101, which have a lower flow velocity, is higher than the pressure in the space between the second main plate 120B and the case top plate 220B, which has a higher flow velocity. That is, the fluid flows into the pump chamber 140B through the first openings 101.

In the fluid control device 10B according to the third embodiment as described above, a flow from the inflow opening 260 toward the first nozzle 251 can be generated.

Furthermore, the configuration of the fluid control device 10B is simpler and lower in cost due to the fourth openings 104, the fifth openings 105, and the second nozzles 252 not being formed.

In the present embodiment, the vibration order of the first main plate 110 is described as a first order vibration. However, the same effect would be obtained with a second order vibration.

Fourth Embodiment

Figure 10A:
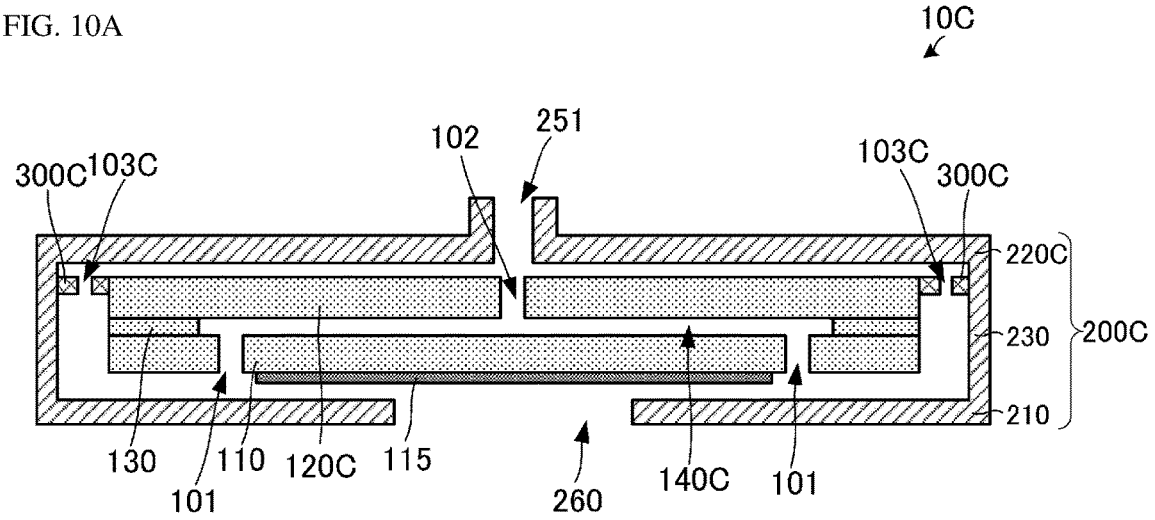
FIG. 10A is a lateral sectional view of a fluid control device 10C according to a fourth embodiment of the present disclosure and FIG. 10B is a diagram schematically illustrating an example of a vibration state of the first main plate 110.
Figure 10B:
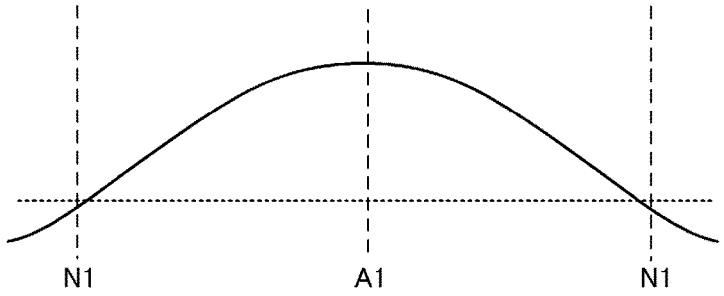
Figure 11:
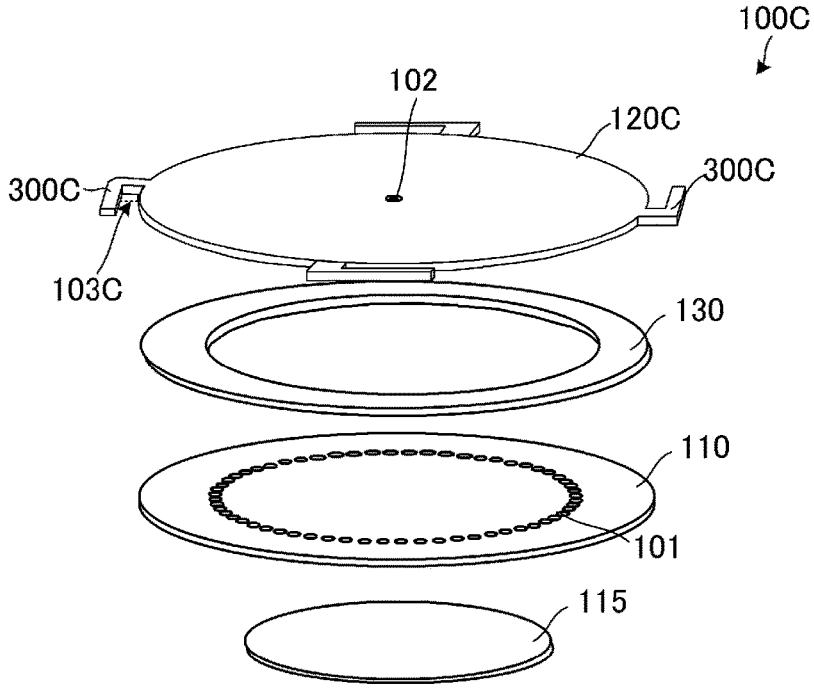
FIG. 11 is an exploded perspective view in which a pump body 100C according to the fourth embodiment of the present disclosure is viewed from a second main plate 120C side.
Figure 12A:
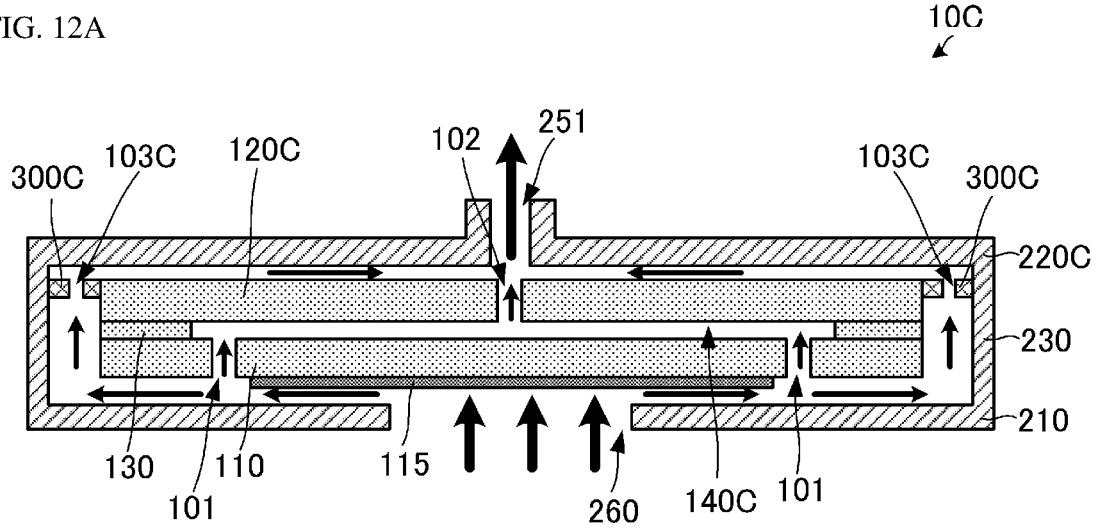
FIG. 12A is a lateral sectional view of the fluid control device 10C according to the fourth embodiment of the present disclosure illustrating fluid flow when a fluid is discharged from the first nozzle 251.
Figure 12B:
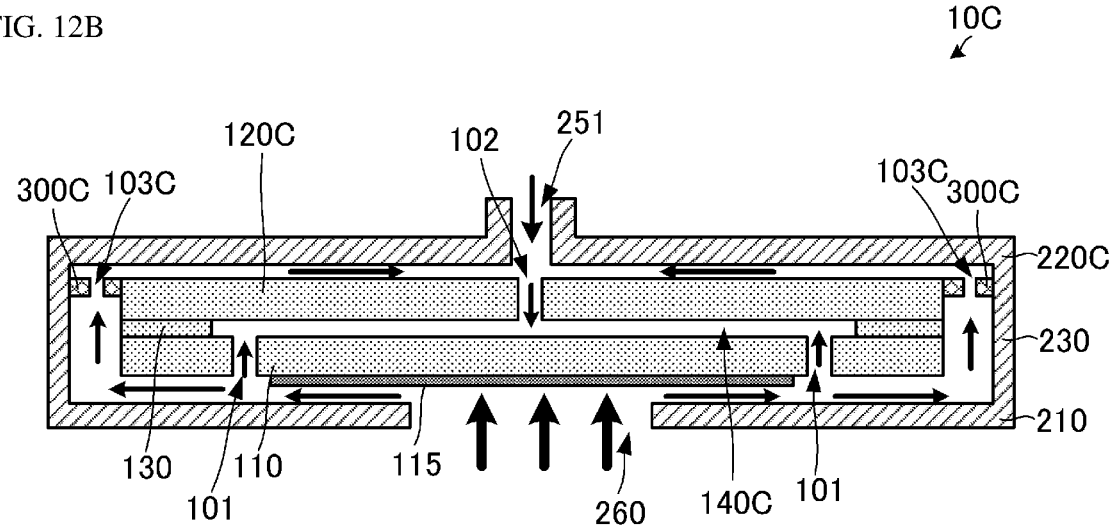
FIG. 12B is a lateral sectional view of the fluid control device 10C according to the fourth embodiment of the present disclosure illustrating fluid flow when a fluid is sucked in from the first nozzle 251.

A fluid control device according to a fourth embodiment of the present disclosure will be described while referring to the drawings. FIG. 10A is a lateral sectional view of a fluid control device 10C according to the fourth embodiment of the present disclosure and FIG. 10B is a diagram schematically illustrating an example of a vibration state of the first main plate 110. FIG. 11 is an exploded perspective view in which a pump body 100C according to the fourth embodiment of the present disclosure is viewed from a second main plate 120C side. FIG. 12A is a lateral sectional view of the fluid control device 10C according to the fourth embodiment of the present disclosure illustrating fluid flow when a fluid is discharged from the first nozzle 251. FIG. 12B is a lateral sectional view of the fluid control device 10C according to the fourth embodiment of the present disclosure illustrating fluid flow when a fluid is sucked in from the first nozzle 251. To make the figures easier to understand, some reference symbols are omitted and some structures are illustrated in an exaggerated manner.

As illustrated in FIGS. 10A, 10B, 11, 12A, and 12B, the fluid control device 10C according to the fourth embodiment differs from the fluid control device 10B according to the third embodiment in that third openings 103C are formed in a holding member 300C. The rest of the configuration of the fluid control device 10C is the same as that of the fluid control device 10B and description of these identical parts is omitted.

As illustrated in FIGS. 10A, 10B, 11, 12A, and 12B, the fluid control device 10C includes a pump body 100C, a case 200C, and the holding member 300C.

With this configuration as well, a flow from the inflow opening 260 toward the first nozzle 251 can be generated, similarly to as in the third embodiment. For example, the pressure that can be generated in the fluid control device 10C is 5 kPa and the flow rate is 3 L/min.

The rigidity of the holding member 300C is reduced by the third openings 103C. This makes it more difficult for the vibration of the pump body 100C to leak into the case 200C. Therefore, the vibrational energy of the first main plate 110 can be more efficiently utilized.

Fifth Embodiment

Figure 13A:
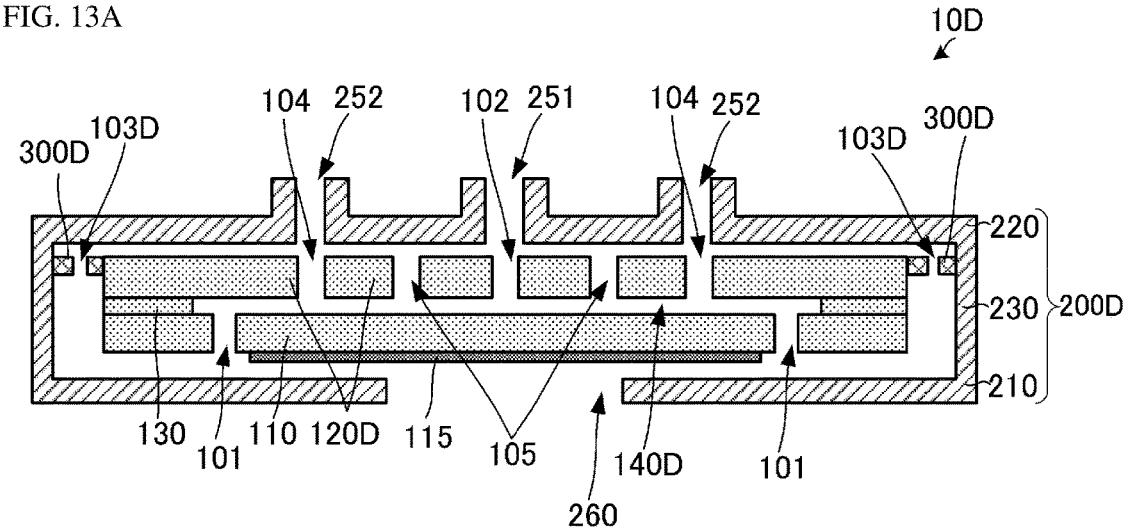
FIG. 13A is a lateral sectional view of a fluid control device 10D according to a fifth embodiment of the present disclosure and FIG. 13B is a diagram schematically illustrating an example of a vibration state of the first main plate 110.
Figure 13B:
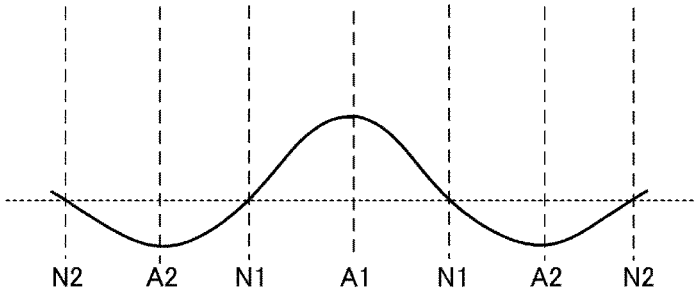
Figure 14:
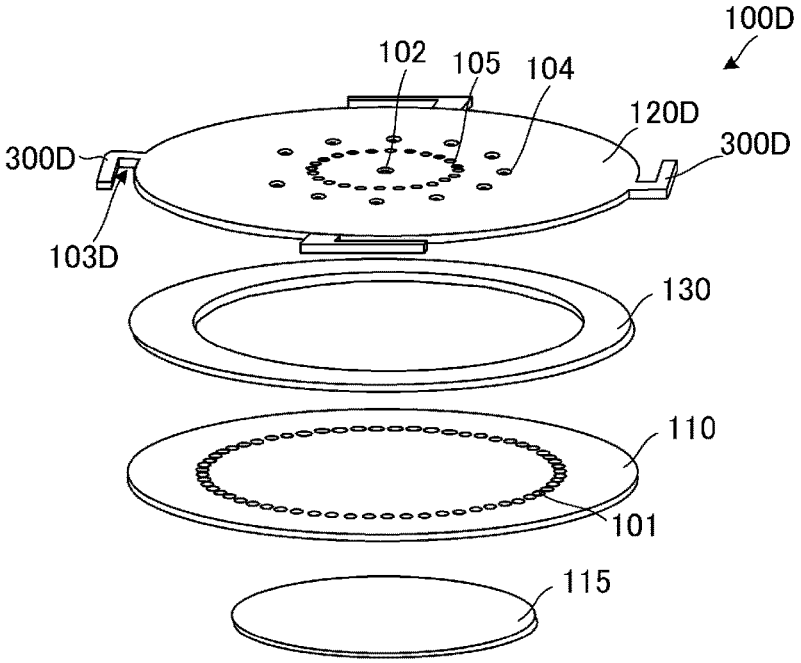
FIG. 14 is an exploded perspective view in which a pump body 100D according to the fifth embodiment of the present disclosure is viewed from a second main plate 120D side.
Figure 15A:
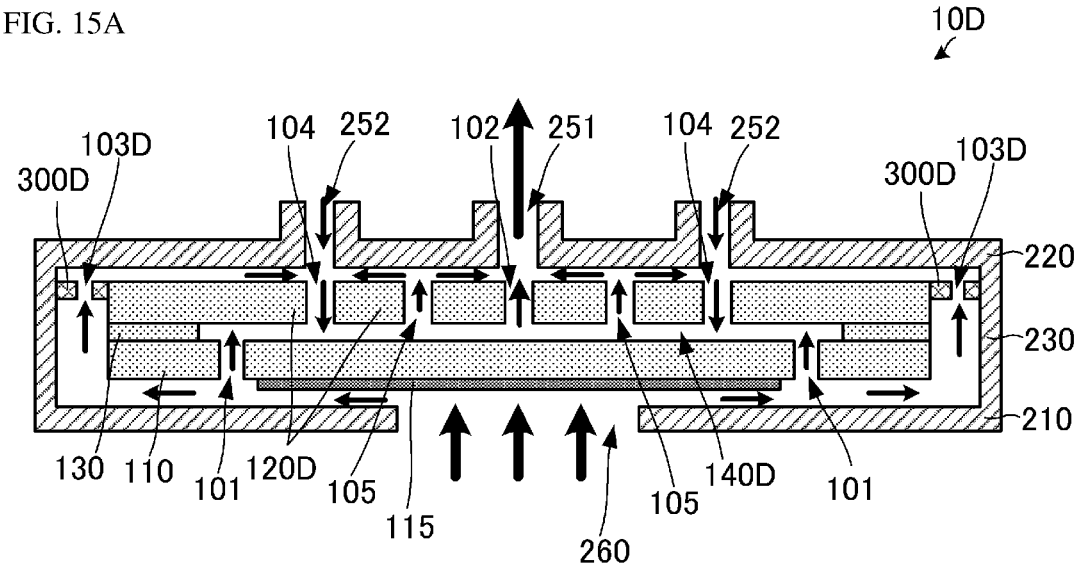
FIG. 15A is a lateral sectional view of the fluid control device 10D according to the fifth embodiment of the present disclosure illustrating fluid flow when a fluid is discharged from the first nozzle 251.
Figure 15B:
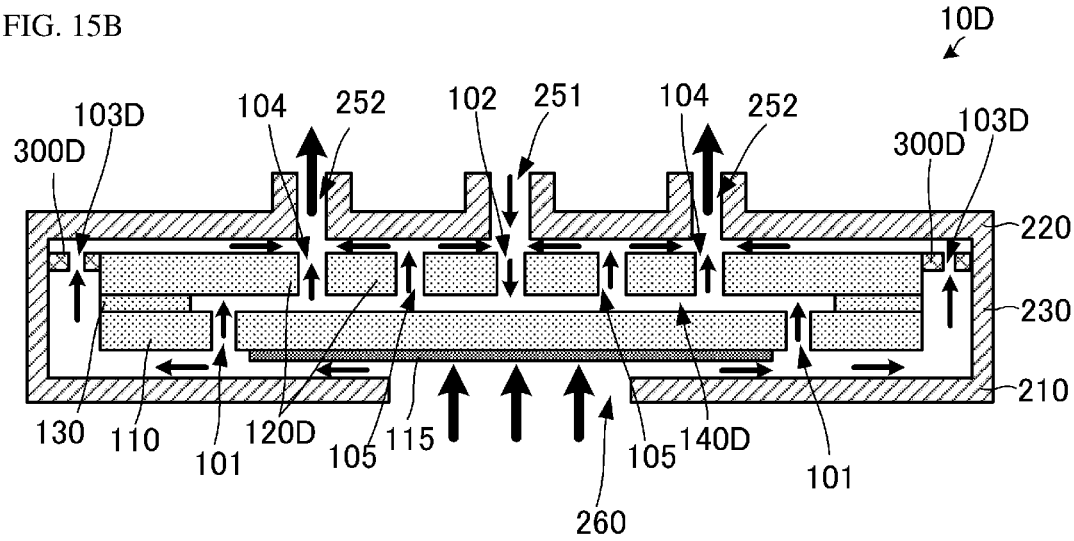
FIG. 15B is a lateral sectional view of the fluid control device 10D according to the fifth embodiment of the present disclosure illustrating fluid flow when a fluid is sucked in from the first nozzle 251.

A fluid control device according to a fifth embodiment of the present disclosure will be described while referring to the drawings. FIG. 13A is a lateral sectional view of a fluid control device 10D according to the fifth embodiment of the present disclosure and FIG. 13B is a diagram schematically illustrating an example of a vibration state of the first main plate 110. FIG. 14 is an exploded perspective view in which a pump body 100D according to the fifth embodiment of the present disclosure is viewed from a second main plate 120D side. FIG. 15A is a lateral sectional view of the fluid control device 10D according to the fifth embodiment of the present disclosure illustrating fluid flow when a fluid is discharged from the first nozzle 251. FIG. 15B is a lateral sectional view of the fluid control device 10D according to the fifth embodiment of the present disclosure illustrating fluid flow when a fluid is sucked in from the first nozzle 251. To make the figures easier to understand, some reference symbols are omitted and some structures are illustrated in an exaggerated manner.

As illustrated in FIGS. 13A, 13B, 14, 15A, and 15B, the fluid control device 10D according to the fifth embodiment differs from the fluid control device 10 according to the first embodiment in that third openings 103D are formed in a holding member 300D. The rest of the configuration of the fluid control device 10D is the same as that of the fluid control device 10 and description of these identical parts is omitted.

With this configuration as well, a flow from the inflow opening 260 toward the first nozzle 251 can be generated, similarly to as in the first embodiment.

In this configuration, the rigidity of the holding member 300D is reduced by the third openings 103D and therefore it is more difficult for the vibration of the pump body 100D to leak into a case 200D. Therefore, the vibrational energy of the first main plate 110 can be more efficiently utilized.

In the configurations described above, nozzles are provided in the case top plate, but it is optional to provide nozzles. For example, the same effect can be achieved by simply providing vent holes having the same thickness as the case top plate.

In the configurations described above, the vibration orders of the diaphragm have been described as secondary and primary vibrations, but the vibration orders are not limited to secondary and primary vibrations. For example, the same effect can be achieved by matching the positions of the openings with the antinodes and nodes of the vibration in the case where the vibration is of the third order or higher.

In addition, in the first, second, and fifth embodiments, the second opening 102 and the first nozzle 251 do not necessarily have to be formed. In this case, the discharge flow rate from the second nozzles 252 can be obtained and therefore the same effect can be obtained.

In all of the above configurations, a particularly high flow rate is obtained when the vibration frequency f of the diaphragm lies in the range shown in the following formula. In the following formula, c is the acoustic velocity of the fluid, a is the radius of a circle enclosed by the first openings 101, and $k_0$ is a constant that satisfies $J_0(k_0)=0$. For example, under conditions of air at room temperature, c is 340 m/s and $k_0$ is 2.40, 5.52, 8.65 etc.

$$\frac{5}{6}\times\frac{ck_0}{2\pi a}\leq f\leq\frac{7}{6}\times\frac{ck_0}{2\pi a} \quad \text{[Math 1]}$$

In this case, a pressure standing wave is generated inside the pump chamber and pressure changes caused by vibrations of the diaphragm are amplified. This results in a particularly large flow rate being achieved because pressure vibrations having a large amplitude are generated inside the pump chamber.

The vibration frequency f of the diaphragm can be obtained by measuring the vibration of the diaphragm using a laser Doppler displacement meter or the like. Since the vibration frequency f also coincides with the fundamental frequency of an AC voltage input to the piezoelectric element, the vibration frequency f can also be obtained by measuring the voltage input to the piezoelectric element or the current flowing in the circuit.

REFERENCE SIGNS LIST

A1, A2 . . . antinode
d1, d2 . . . recess
N1, N2 . . . node
10, 10A, 10B, 10C, 10D . . . fluid control device
100, 100A, 100B, 100C, 100D . . . pump body
101 . . . first openings
102 . . . second opening
103, 103C, 103D . . . third openings
104 . . . fourth openings
105 . . . fifth openings
110 . . . first main plate
115 . . . driving member
120, 120A, 120B, 120C, 120D . . . second main plate
130 . . . side plate
140, 140B . . . pump chamber
200, 200B, 200C, 200D . . . case
210 . . . case bottom plate
220, 220B . . . case top plate
230 . . . case side plate
251 . . . first nozzle
252 . . . second nozzles
260 . . . inflow opening
300, 300C, 300D . . . holding member

The invention claimed is:

1. A fluid control device comprising:

a case including a case top plate having a first vent hole substantially at a center of the case top plate, a case bottom plate having a second vent hole substantially at a center of the case bottom plate, and a case side plate that connects the case top plate and the case bottom plate;

a pump body that is arranged inside a space enclosed by the case top plate, the case side plate, and the case bottom plate of the case; and a holding member that holds the pump body relative to the case;

wherein the pump body includes a first main plate having one main surface, a second main plate having one main surface that faces the one main surface of the first main plate, a side plate of the pump body that connects the first main plate and the second main plate to each other, and a driving member that is arranged on the first main plate, the holding member connects the side plate of the pump body and the case side plate to each other, the first main plate has a plurality of first openings arranged in a ring shape, and the second main plate is closer to the case top plate than the first main plate is, and the second main plate has a second opening at a position that overlaps the first vent hole in a plan view of the case top plate.

2. The fluid control device according to claim 1, wherein the second main plate or the holding member has a third opening that allows the first vent hole and the second vent hole to communicate with each other.

3. The fluid control device according to claim 1, wherein the case top plate includes a third vent hole at a position that is separated from the center thereof in the plan view of the case top plate, and the second main plate has fourth openings that overlap the third vent hole in the plan view of the case top plate.

4. The fluid control device according to claim 3, wherein the second main plate has a plurality of fifth openings that do not face the first vent hole and the third vent hole.

5. The fluid control device according to claim 4, wherein the fifth openings are located between the second opening and the fourth openings in a plan view of the second main plate.

6. The fluid control device according to claim 3, wherein the fourth openings are in a ring shape so as to overlap an antinode of vibration of the first main plate in accordance with a vibration order of the driving member.

7. The fluid control device according to claim 4, wherein the fifth openings are in a ring shape so as to overlap a node of vibration of the first main plate in accordance with a vibration order of the driving member.

8. The fluid control device according to claim 1, wherein the first openings are radially outside the driving member in a plan view of the first main plate.

9. The fluid control device according to claim 2, wherein the case top plate includes a third vent hole at a position that is separated from the center thereof in the plan view of the case top plate, and the second main plate has fourth openings that overlap the third vent hole in the plan view of the case top plate.

10. The fluid control device according to claim 4, wherein the fourth openings are in a ring shape so as to overlap an antinode of vibration of the first main plate in accordance with a vibration order of the driving member.

11. The fluid control device according to claim 5, wherein the fourth openings are in a ring shape so as to overlap an antinode of vibration of the first main plate in accordance with a vibration order of the driving member.

12. The fluid control device according to claim 5, wherein the fifth openings are in a ring shape so as to overlap a node of vibration of the first main plate in accordance with a vibration order of the driving member.

13. The fluid control device according to claim 2, wherein the first openings are radially outside the driving member in a plan view of the first main plate.

14. The fluid control device according to claim 3, wherein the first openings are radially outside the driving member in a plan view of the first main plate.

15. The fluid control device according to claim 4, wherein the first openings are radially outside the driving member in a plan view of the first main plate.

16. The fluid control device according to claim 5, wherein the first openings are radially outside the driving member in a plan view of the first main plate.

17. The fluid control device according to claim 6, wherein the first openings are radially outside the driving member in a plan view of the first main plate.

18. The fluid control device according to claim 7, wherein the first openings are radially outside the driving member in a plan view of the first main plate.

* * * * *